United States Patent [19]

Musolino

[11] Patent Number: 4,568,082

[45] Date of Patent: Feb. 4, 1986

[54] BOARD GAME

[76] Inventor: Nick J. Musolino, 5268 Manassas Ave., Las Vegas, Nev. 89122

[21] Appl. No.: 667,158

[22] Filed: Nov. 1, 1984

[51] Int. Cl.[4] ..... A63F 9/10

[52] U.S. Cl. ..... 273/157 R; 273/236

[58] Field of Search ..... 273/236, 156, 157 R

[56] References Cited

U.S. PATENT DOCUMENTS

| | | | |
|---|---|---|---|
| 669,445 | 3/1901 | Morey | 273/157 R |
| 1,869,864 | 8/1932 | Phillips | 273/157 R |
| 1,996,834 | 4/1935 | Schleicher | 273/157 R |
| 3,464,145 | 9/1969 | Martin | 273/157 R X |
| 3,643,956 | 2/1972 | Bovasso | 273/157 R X |
| 4,114,877 | 9/1978 | Goldfarb et al. | 273/157 R X |
| 4,177,305 | 12/1979 | Feingold et al. | 273/157 R X |

FOREIGN PATENT DOCUMENTS

| | | | |
|---|---|---|---|
| 403691 | 12/1933 | United Kingdom | 273/157 R |
| 490302 | 8/1938 | United Kingdom | 273/157 R |

*Primary Examiner*—Anton O. Oechsle

*Attorney, Agent, or Firm*—Harpman & Harpman

[57] ABSTRACT

A game played with L-shaped members for positioning upon a playing board having squares defined thereon and color marking in a majority of the squares displaying a fixed pattern of horizontal and vertical continuously extending lines of squares. Each of the L-shaped members having squares defined thereon with at least one of the squares of each of the L-shaped members being marked with a different color. The purpose of the game is to generate by the selective placement of the L-shaped members on the squares of the playing board to obtain an assembly of the L-shaped members with the colored squares thereof overlying the color marked squares of the playing board and wherein each horizontal and vertical row of the colored squares of the L-shaped members display different colors.

7 Claims, 6 Drawing Figures

BOARD GAME

BACKGROUND OF THE INVENTION

1. Technical Field:

This invention relates in general to skill games and puzzle games in which a player can recreate a design on a playing board by means of playing pieces.

2. Description of the Prior Art:

Prior games of this type may be found in U.S. Pat. Nos. 1,869,864 and 3,643,956.

In U.S. Pat. 1,869,864, a plurality of game pieces of various sizes, the surfaces of which are divided into squares and certain of which pieces have a square of a contrasting color is disclosed in which the game pieces are capable of being assembled together in geometrical form with the object of the game being to assemble the pieces so that no colored squares are aligned.

In the present invention the game pieces are L-shaped members of uniform size having squares defined thereon, some of which are colored, and which in playing the game are positioned on a game board having squares designated thereon and color markings controlling the placement of the colored squares of the L-shaped members which comprise the playing pieces.

U.S. Pat. No. 3,643,956 discloses a playing board having squares defined thereon and square members, which may be cards or blocks, disposable on the playing board with each of the square members which are the playing pieces having an identical pattern marked thereon. The square members may be positioned on the playing board in any order as there are no control markings on the game board.

U.S. Pat. No. 3,464,145 discloses a set of blocks for generating designs, U.S. Pat. No. 4,114,877 discloses a game wherein playing pieces having different designs thereon are positioned in panels on a rotatable tower, and U.S. Pat. No. 4,177,305 discloses a wall hanging having a variable picture made of a multitude of interchangeable tiles which snap-fit onto a specially configured picture support assembly.

None of these patents disclose the novel concept of the present invention wherein marked colored squares on the playing board arranged to form crossed horizontal and vertical lines of uncolored squares control the placement of L-shaped members which are the playing pieces, with each of the playing pieces, having squares marked thereon and wherein some of the squares are color marked with different colors so as to provide a challenge to the player in arranging the playing pieces on the playing board.

SUMMARY OF THE INVENTION

A board game provides a playing board having a representation of a plurality of squares thereon in vertical and horizontal rows, some of the squares being color marked and so positioned as to form crossed horizontal and vertical lines of uncolored squares and a plurality of playing pieces, each of which somprises an L-shaped member having four squares designated thereon with each of the playing pieces having at least one of the squares color marked in one of a predetermined number of colors and wherein placing the playing pieces on the playing board is controlled by the rule requiring the colored squares on the playing pieces to overlie the colored squares on the playing board and the uncolored squares on the playing pieces to define the same overlying vertical and horizontal lines of squares matching the playing board.

DESCRIPTION OF THE PREFERRED EMBODIMENT

Figure 1:
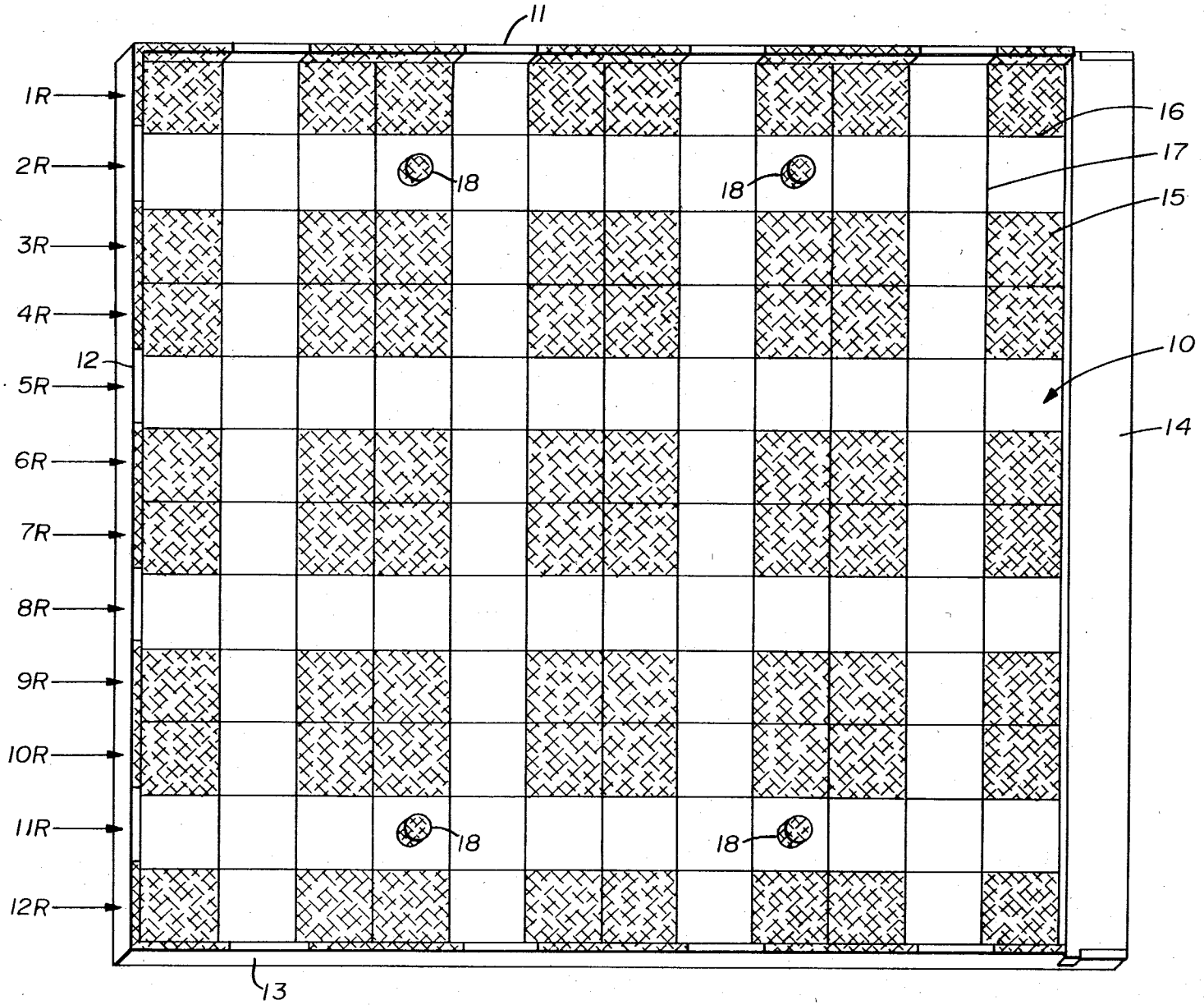
FIG. 1 is a top plan view of the board of the board game showing a plurality of crossed horizontal and vertical lines of squares thereon, some of which are color marked and arranged to separate crossed lines of uncolored squares running horizontally and vertically of the board.

In the form of the invention chosen for illustration and description herein, the playing board as illustrated in FIG. 1 of the drawings, has a square, flat upper surface 10 with three upstanding edge flanges 11, 12 and 13 on three sides thereof and a removable body member 14 of a thickness slightly less than the height of the upstanding flanges 11, 12 and 13.

The square, flat upper surface 10 of the playing board is divided into a plurality of squares 15 by a plurality of horizontally and vertically extending lines 16 and 17 respectively, so that there are twelve rows of squares running horizontally or transversely of the board from left to right as seen in FIG. 1 of the drawings, and twelve rows of squares running at right angles thereto, from the bottom of the board to the top thereof as seen in FIG. 1 of the drawings.

Still referring to FIG. 1 of the drawings, it will be seen that the square, flat upper surface 10 of the playing board has eight of the twelve squares in the uppermost row shaded to indicate the color orange and that this pattern is repeated in seven of the other horizontal or transversely extending rows of squares. The arrangement is such that counting downwardly from the uppermost row of squares as seen in FIG. 1 of the drawings, the third and fourth rows, the sixth and seventh rows, the ninth and tenth rows and the twelfth row repeat the orange shaded marking of the first or uppermost row as seen in FIG. 1 of the drawings and it will be observed that this arrangement of marked, colored squares forms a pattern of two orange colored squares around the periphery of the square, flat upper surface 10 of the playing board and at the same time forms nine enlarged color marked squares, each of which encompasses four of the squares defined by the lines 16 and 17.

It will also be seen that the square, flat upper surface 10 of the playing board has been provided with four upstanding cross sectionally round pegs 18. These pegs are located in the second and eleventh horizontal or transverse row of squares and spaced inwardly from the right and left sides of the playing board by being located in the fourth and ninth vertical rows respectively, all as illustrated in FIG. 1 of the drawings.

In FIG. 1 of the drawings, the reference numerals 1R through 12R indicate the horizontal or transversely arranged rows of squares 15.

Figure 3:
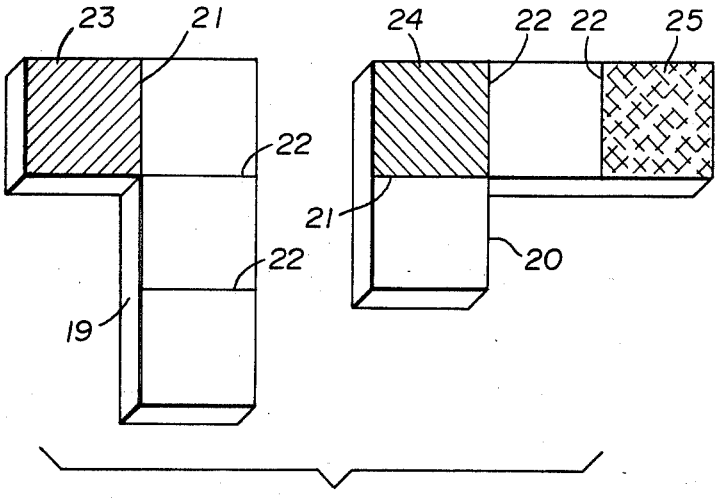
FIG. 3 is a composite enlarged view of two of the L-shaped playing pieces seen in FIG. 2 of the drawings.

By referring now to FIG. 3 of the drawings, a composite enlarged perspective view of two of the thirty-six L-shaped members which form the playing pieces may be seen. These are indicated by the numerals 19 and 20 respectively and it will be seen that both of the playing pieces 19 and 20 have lines 21 and 22 thereon dividing the uppermost surfaces of the playing pieces 19 and 20 into four equally sized squares which are the same size as the squares 15 on the square, flat upper surface 10 of the playing board as seen in FIG. 1 of the drawings and heretofore described.

In FIG. 3 of the drawings, the playing piece 19 has three uncolored squares in end to end relation abutting the lines 22 and one colored square 23 lined for the color brown and extending to the left of the line 21, while the L-shaped playing piece 20 has two uncolored squares, one on either side of the line 21 in diagonal relation, and two colored squares, a green lined square 24 and an orange lined square 25 which are spaced by the intermediate uncolored square between the lines 22 on the playing piece 20.

Figure 2:
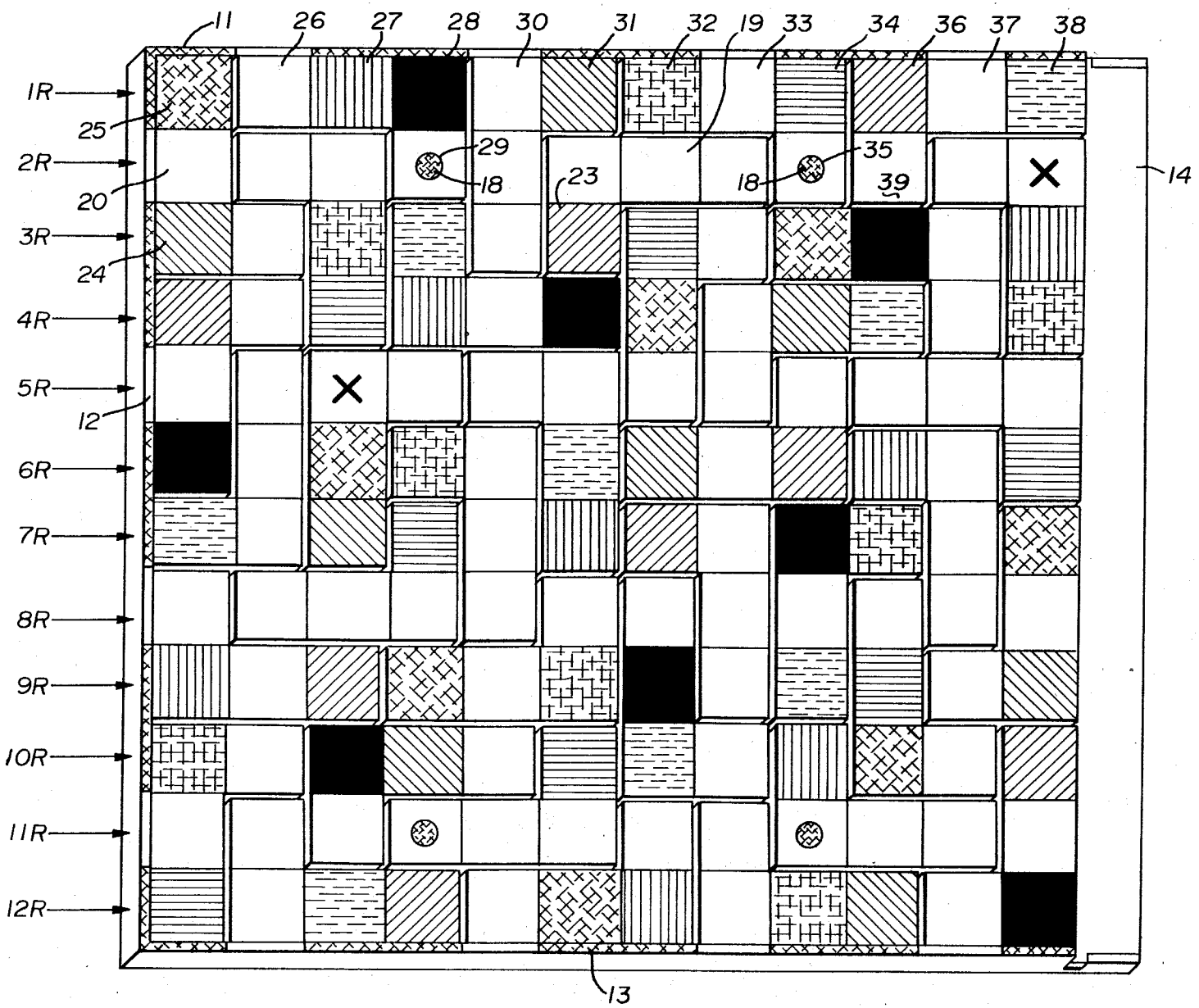
FIG. 2 is a top plan view of the playing board of FIG. 1 showing thirty-six L-shaped playing pieces in position thereon with colored squares of the playing pieces overlying the colored squares of the playing board and uncolored squares of the playing pieces overlying the uncolored squares of the crossed lines of squares of the playing board.

By referring now to FIG. 2 of the drawings, a top plan view of the playing board with all thirty-six L-shaped members, which comprise the playing pieces, in position thereon and it will be observed that the two playing pieces illustrated in enlarged detail in FIG. 3 of the drawings and heretofore described may be seen in FIG. 2 of the drawings.

The playing piece 20 with its green and orange colored squares 24 and 25 respectively is seen in the upper left hand portion of the illustration of the game in FIG. 2 of the drawings and the playing piece 19 may be seen occupying the horizontal or transverse second row (see FIG. 1) and spaced inwardly from the left side of FIG. 2 and occupying the sixth, seventh and eighth vertical rows respectively in FIG. 2 of the drawings.

In FIG. 2 of the drawings, the colored squares of the L-shaped members forming the playing pieces will be seen to be positioned on the playing board as seen in FIG. 1 of the drawings with the colored squares of the playing pieces overlying the orange colored squares of the playing board and with the uncolored squares of the L-shaped playing pieces overlying the uncolored squares defining the horizontal or transverse rows and vertical rows of squares as seen in FIG. 1 of the drawings.

In FIG. 2 of the drawings, the uppermost or first horizontal or transverse row 1R is formed of five L-shaped playing pieces as follows. The first playing piece comprising the L-shaped member 20 heretofore described with its orange colored square in the lefthand, uppermost corner of FIG. 2 and its green colored square 24 two squares therebelow. The second playing piece in row 1R comprises the uncolored square 26, the red square 27, and the black square 28 with the offset portion of the L-shaped member having an opening 29 therein which is engaged over one of the pegs 18 as seen in FIG. 1 of the drawings. The third L-shaped member comprises the adjacent uncolored square 30 and the two uncolored squares therebelow and the green colored square 31. The next or fourth L-shaped member comprises the yellow colored square 32, the adjacent uncolored square 33, and its adjacent blue colored square 34 with the remaining portion having an opening 35 therein registering with another of the pegs 18 as seen in FIG. 1 of the drawings. The last and fifth L-shaped member, has the brown colored square 36, the uncolored square 37 adjacent thereto, and the grey square 38, the fourth square of this last piece is the uncolored square 39 immediately below the brown colored square 36. It will observed that in this example of a typical horizontal or transverse line of colored squares of the L-shaped members comprising the playing pieces in this game, the row just described includes eight different colored squares and four uncolored squares. It will be further observed that the second row down, 2R, which conforms with the row 2R on the square, flat upper surface 10 of the playing board of FIG. 1 of the drawings, is comprised entirely of uncolored squares.

It will be observed that this same pattern continues downwardly through the successive horizontal or transverse rows of the L-shaped members which comprise the playing pieces with each of the horizontal or transverse rows having eight different colored squares and four uncolored squares.

Still referring to FIG. 2 of the drawings, it will be seen that the third and fourth rows down from the upper portion of FIG. 2 comprise the rows of colored squares with each of the colors in each row being different from the other colors in that row and that these side by side third and fourth rows of colored squares are positioned over the orange colored squares of the third and fourth rows from the top as seen in FIG. 1 and illustrating the square, flat upper surface 10 of the playing board.

It will be seen that the transverse arrangement of the different colored squares in each of the colored rows of FIG. 2 of the drawings is different and this is caused by reason of the formation of the thirty-six individual L-shaped members which comprise the playing pieces as each of them has a different colored and uncolored square arrangement.

It will also be seen that the L-shaped members which comprise the playing pieces are positioned in the final properly registering relation with respect to the orange colored squares and the uncolored lines forming the square, flat upper surface 10 of the playing board.

Still referring to FIG. 2 of the drawings, it will be seen that the abutting edges of each of the thirty-six L-shaped members which form the playing pieces has been illustrated with a separate line to enable the positioning of each of the thirty-six playing pieces to be determined. The abutting edges of the thirty-six playing pieces are therefore shown by the double lines and it will be appreciated that the spacing thus illustrated is somewhat exaggerated as the thirty-six playing pieces closely abut one another in their final predetermined position.

It will occur to those skilled in the art, that by changing the appearance of the upper surfaces of each of the thirty-six L-shaped members which form the playing pieces, different appearing games can be played on the same playing board and its color marked areas. For example in FIG. 4 of the drawings, L-shaped playing pieces carrying the letters A,B,C and D for identification in this disclosure only, are illustrated in which the playing piece indicated by the letter A has two uncolored squares 40 and 41, a brown square 42 with a smaller sized black square 43 centrally thereof and a blue square 44 is positioned in the upper lefthand corner of a broken away portion of the game board illustrated in top plan view in FIG. 1 of the drawings and heretofore described. The game board 10 has the same orange markings in the same pattern as seen in FIG. 1 of the drawings and the colored squares with or without the smaller central black centers are again arranged to overlie the orange colored squares defining the horizontal and vertical lines forming the square, flat upper surface 10 of the game board.

Figure 4:
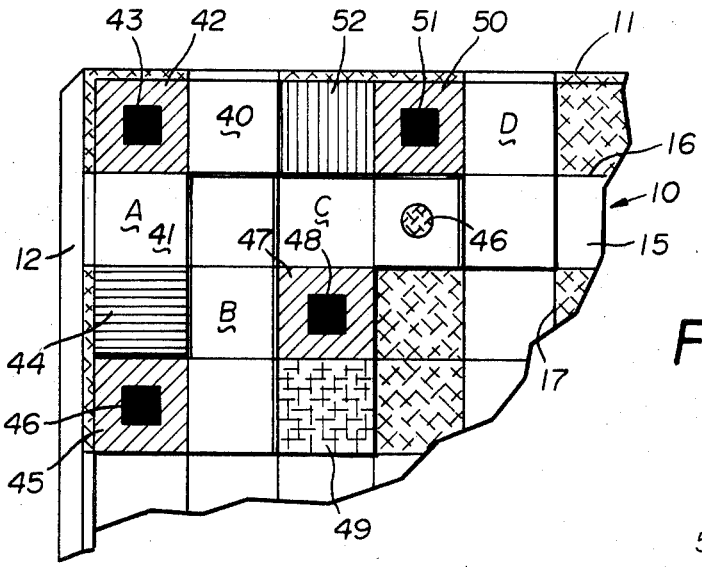
FIG. 4 is a top plan view of a portion of a playing board having L-shaped playing pieces with modified colored indicia.

In FIG. 4 of the drawings, the second L-shaped member is indicated by the letter B and has three uncolored squares and one brown colored square 45 with a smaller black central portion 46. The third L-shaped member is indicated by the reference letter C, it has two uncolored squares, one with an opening 46 therein for registry over one of the pins 18 on the game board, a brown square 47 with a black square center 48 and an adjacent yellow colored square 49. The fourth L-shaped member or game piece is indicated by the reference letter D, it has two uncolored squares, a brown square 50 with a square black smaller center 51 and an adjacent red square 52. The abutting edges of the four pieces A,B,C and D are illustrated with double lines to distinguish the positioning of the L-shaped members which form the playing pieces.

Other and somewhat different games may be played on the game board disclosed herein by further altering the appearance of the upper surface of the L-shaped members which form the playing pieces.

Figure 5:
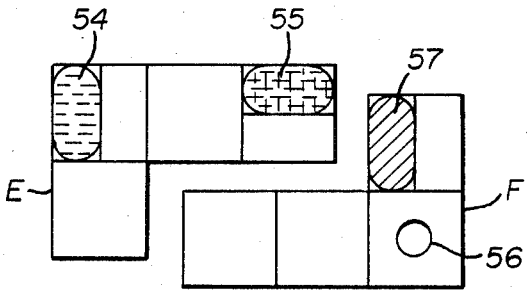
FIG. 5 is a composite view of two playing pieces having modified colored indicia.

In FIG. 5, a composite view of two alternate L-shaped members E and F may be seen in top plan view. These alternate L-shaped members are two of thirty-six similar L-shaped members which comprise playing pieces in a modification of the game described hereinbefore. It will be observed as heretofore described in connection with FIG. 3 of the drawings that the prefrred markings on the L-shaped game pieces are different colored squares along with uncolored squares whereas in the modification of the game pieces shown in FIG. 5 of the drawings, the markings comprise oval-shaped colored sections in one half of one or more of the squares of the modified L-shaped members E and F.

In the left hand L-shaped member E, a gray colored oval 54 is formed in one-half of one of the four squares appearing on the L-shaped member while another of the squares of the L-shaped member E has one-half thereof containing a representation of a yellow oval 55. It will be seen that the grey oval 54 and the yellow oval 55 are positioned at right angles to one another and that the remaining portions of the squares in which they are positioned are uncolored as are the other two squares making up the L-shaped member E.

In the right hand L-shaped member F, three of the squares are uncolored, one has an opening 56 therein for registry with one of the pegs 18 on the playing board surface 10 in FIG. 1 of the drawings, while the remaining square is divided in half vertically and a brown colored oval 57 appears therein.

Figure 6:
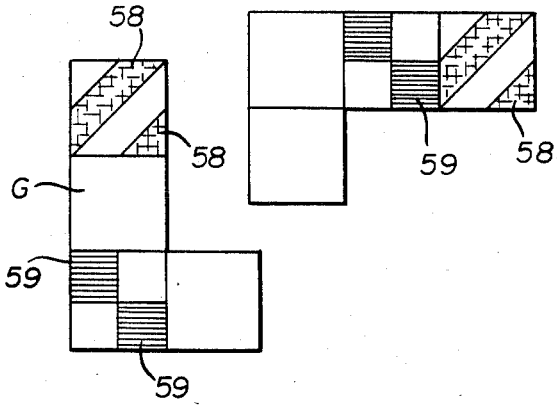
FIG. 6 is an enlarged view of two L-shaped playing pieces having a still further modified color marked indicia thereon.

A still further version of a game variation resulting from changes the color markings and arrangement thereof on the L-shaped playing pieces may be seen. In FIG. 6 of the drawings, the left hand game piece is indicated by the letter G and includes the usual four squares which like the other game pieces are of the same size as the squares 15 on the game board surface 10. In the L-shaped member G, one of the four squares has portions of two diagonally positioned yellow stripes 58 thereon, while another of the squares has been divided into four quarters and two of these in diagonal arrangement have blue colored markings 59. The modified game piece shown in the right of FIG. 6 has the usual four squares with a different pair of the squares containing the yellow and blue markings 58 and 59 respectively.

In playing modified games with the modified L-shaped members which are the playing pieces, thirty-six game pieces being used in each game, the different colored markings on the L-shaped members must overlie the orange colored squares and groups of squares on the square, flat upper surface 10 of the game board as shown in FIG. 1 of the drawings.

It will thus be seen that various games may be played with the game board invention disclosed herein by modifying the markings on the game pieces and it will be further understood that it is within the scope of the invention to vary the control pattern of the orange squares as disclosed in connection with FIG. 1 of the drawings so that different arrangements of the thirty-six game pieces used in each of the games will have to be positioned in different relation to the game board so as to conform with any changed markings thereon and it will be further understood that while the several colors that are specifically mentioned herein are desirable, the same may be changed without departing from the spirit of the invention or the claims appended hereto and having thus described my invention what I claim is:

1. In a game apparatus for playing a game upon a playing board having multiple squares delineated upon its surface, some of said multiple squares having identical markings and arranged individually and in groups spaced with respect to one another and defining crossed horizontally and vertically extending lines of unmarked squares and forming game control means, playing pieces consisting of a set of differently marked, identically shaped, L-shaped members, markings on said L-shaped members consisting of lines delineating multiple squares and further marking in some of said multiple squares on said L-shaped members, said further marking consisting of a plurality of different appearing markings relative to each other, the squares on the board and on the pieces being of essentially the same size.

2. The game apparatus set forth in claim 1 and wherein said identical marking in said multiple squares on the surface of said playing board comprise a single color.

3. The game apparatus set forth in claim 1 and wherein said identical marking in said multiple squares on the surface of said playing board comprise a single color and wherein said further marking in some of said multiple squares on said L-shaped members consists of a plurality of different colors.

4. The game apparatus set forth in claim 1 and wherein each of said multiple squares on said surface of said playing board and said multiple squares on said L-shaped members are of the same size so that said L-shaped members may be positioned on said surface of said playing board with said squares in superimposed registry.

5. The game apparatus set forth in claim 1 and wherein said multiple squares on said surface of said playing board are arranged in twelve transverse rows and twelve rows at right angles thereto and crossing one another and wherein there are twelve squares in each of said rows.

6. The game apparatus set forth in claim 1 and wherein said surface of said playing board is square and wherein said multiple squares on said surface arranged individually and in groups spaced with respect to one another define four horizontally and four vertically extending lines of unmarked squares.

7. The game apparatus set forth in claim 3 and wherein there are eight different colors comprising the markings on said L-shaped members and wherein at least one of said eight different colors comprising the marking on each of said L-shaped members.

* * * * *